US005858110A

United States Patent [19]

Jackson et al.

[11] Patent Number: 5,858,110

[45] Date of Patent: Jan. 12, 1999

[54] METHOD OF WALLPAPER REMOVAL

[76] Inventors: Richard L. Jackson; John Stacy, both of 422 5Th Ave., #310, Madison, Minn. 56256-1211

[21] Appl. No.: 572,862

[22] Filed: Dec. 14, 1995

[51] Int. Cl.[6] ..... B08B 7/00

[52] U.S. Cl. ..... 134/6; 134/7; 134/38

[58] Field of Search ..... 134/4, 6, 7, 26, 134/38

[56] References Cited

U.S. PATENT DOCUMENTS

| | | | |
|---|---|---|---|
| 137,396 | 4/1873 | Ware | 134/4 |
| 1,070,244 | 8/1913 | Fischer et al. | 134/4 |
| 1,083,007 | 12/1913 | Ellis | 134/4 |
| 2,221,960 | 11/1940 | Abramowitz | 252/161 |
| 2,495,729 | 1/1950 | Hutson et al. | 134/4 |
| 3,149,364 | 9/1964 | Baptist et al. | 134/4 |
| 3,514,854 | 6/1970 | Norfleet | 134/4 |
| 3,578,499 | 5/1971 | Crotty et al. | 134/4 |
| 3,715,264 | 2/1973 | Burton | 134/4 |
| 3,950,185 | 4/1976 | Toyama et al. | 134/4 |
| 4,274,884 | 6/1981 | Cartwright | 134/4 |
| 4,361,452 | 11/1982 | Clark et al. | 156/71 |
| 4,426,250 | 1/1984 | Brailsford | 134/38 |
| 4,579,627 | 4/1986 | Brailsford | 134/4 |
| 4,834,803 | 5/1989 | Knowlton | 134/4 |
| 4,979,526 | 12/1990 | Rudy | 134/4 |

FOREIGN PATENT DOCUMENTS

| | | |
|---|---|---|
| 234645 | 4/1986 | Germany . |
| 3427484 | 6/1986 | Germany . |

OTHER PUBLICATIONS

Scientific American –"How To Remove Old Wallpaper" Jan. 25,1913.

Popular Mechanics –The Hang Of Wallpapering –Mar./1954 –PP 177 –182.

*Primary Examiner*—Zeinab El-Arini

*Attorney, Agent, or Firm*—Patent & Trademark Services; Joseph H. McGlynn

[57] ABSTRACT

A method of removing wall paper which includes the steps of dipping an absorbent fabric into water or a solution of aqueous wall paper remover. Allowing excess solution to drain from the fabric and then placing the fabric in direct contact with the wall paper. The fabric adheres to the wall merely through water cohesion. The fabric is allowed to remain on the wall paper for a period of time to allow the solution to soak into the paper. Once this occurs, the fabric is removed and the paper can be scraped off the wall.

3 Claims, No Drawings

METHOD OF WALLPAPER REMOVAL

BACKGROUND OF THE INVENTION

This invention relates, in general, to removing wallpaper, and, in particular, to a new method for removing wallpaper.

DESCRIPTION OF THE PRIOR ART

In the prior art various types of wall paper removal devices and systems have been proposed. For example, U.S. Pat. No. 1,070,241 discloses a tool for perforating wall paper to allow moisture to penetrate the paper and loosen the glue before the paper is removed. U.S. Pat. No. 1,083,007 discloses a solution of hygroscopic salts that is used to soften wall paper glue to aid in the removal of the paper. U.S. Pat. No. 137,396 discloses filling a room with steam to help loosen wall paper glue. U.S. Pat. No. 4,979,526 discloses a method for removing wall paper which consists of wetting the paper and then placing a vapor barrier on the paper to retain the moisture in contact with the paper for a longer period of time.

While the problem of removing wall paper has plagued homeowner and decorators for over a century, and many attempted solutions have been proposed, the difficult process still remains today. Many solutions have been proposed over the years, however, none have been proven entirely satisfactory.

All of the prior art methods suffer from serious and sometimes dangerous drawbacks. For example the system proposed by U.S. Pat. No. 137,396 of filling a room with steam is time consuming and can damage woodwork. Using chemicals such as proposed by U.S. Pat. No. 1,083,007 and others can be dangerous to the user and environmentally unsafe. Other solutions such as the vapor barrier of U.S. Pat. No. 4,979,526 can be extremely expensive. Therefore, the need for a simple, reliable, inexpensive and safe method of removing wall paper still remains today.

SUMMARY OF THE INVENTION

The present invention solves the problems inherent in the wall paper removal systems of the prior art. The present method comprises dipping an absorbent fabric into water or a solution of aqueous wall paper remover. Excess solution is allowed to drain from the fabric and then the fabric is placed in direct contact with the wall paper. The fabric adheres to the wall merely through water cohesion. The fabric is allowed to remain on the wall paper for a period of time to allow the solution to soak into the paper. Once this occurs, the fabric is removed and the paper can be scraped off the wall.

It is an object of the present invention to provide a simple, reliable, inexpensive and safe method of removing wall paper.

It is an object of the present invention to provide a method of removing wall paper that requires only readily available tools.

It is an object of the present invention to provide a method of removing wall paper that is environmentally safe.

These and other objects and advantages of the present invention will be fully apparent from the following description, when taken in connection with the annexed drawings.

DESCRIPTION OF THE PREFERRED EMBODIMENT

Referring now to the present invention in greater detail, the method of wall paper removal comprises utilizing a fabric which weighs about 90 g/m$^2$. The fabric is a composite of non-woven rayon and non-woven polypropylene which is cut into sheets which can be easily handled by a single person. The sheets of fabric are then placed into a container which holds warm water and a small amount of dish detergent. The sheets are removed one at a time, the excess water is allowed to drain off and, then the fabric is placed in contact with the wall paper. The sheets of fabric will adhere to the surface of the wall through water cohesion between the fabric and the wall paper.

It is best to start at the top of the wall and work your way down until an entire section of the wall paper is covered. The fabric is applied at the top first and then smoothed out to the sides and the bottom. After the first sheet is applied, another sheet is removed from the container and the process is repeated until the entire wall section is covered.

After twenty minutes, the surface of the fabric is sprayed with the same warm water and soap solution. This process can be repeated until the fabric has been on the wall for approximately 45 minutes. After this time, the fabric is removed and the wall paper can be scraped off. The fabric sheets can be saved and reused on another section of wall in the same or a different room. Also, the fabric can be washed and dried in the gentle cycle of a clothes dryer and used repeatedly.

If any wall paper glue remains after the paper has been stripped, it can be removed by reapplying the sheets of fabric, or by simply spraying the bare wall and then wiping off the glue. Which method will be used will depend on the amount of glue remaining.

In the case of waterproof wall paper, such as vinyl, the wall paper can first be scored with a tool similar to the tool disclosed in U.S. Pat. No. 1,070,241, which is incorporated herein by reference. This type of tool punctures the paper and allows the water solution to make contact with the wall paper glue. Also, this tool might have to be used if there is more than one layer of wall paper on the wall, or if the paper has been painted over. Once the paper has been punctured, the process for removing the wall paper is the same as described above.

Although the method of removing wall paper according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method of removing wall paper from a surface to which it is adhered comprising the steps of:

A. saturating a non-woven fabric solely with water;

B. allowing excess water to drain off said fabric;

C. applying said fabric to said wall paper by means of water cohesion;

D. allowing said fabric to remain in contact with said wall paper for a period of time;

E. removing said fabric from said wall paper; and

F. removing said wall paper.

2. The method of removing wall paper as claimed in claim 1, wherein said method includes the additional step of:

spraying additional water on said fabric between steps C and D.

3. The method of removing wall paper as claimed in claim 1, wherein said method includes the additional step of:

scoring said wall paper prior to step C.

* * * * *